US007916025B2

(12) United States Patent
Locker et al.

(10) Patent No.: US 7,916,025 B2
(45) Date of Patent: Mar. 29, 2011

(54) INTELLIGENT LUGGAGE TAG

(75) Inventors: Howard J. Locker, Dallas, TX (US); Timothy Q. Nguyen, Pearland, TX (US)

(73) Assignee: Lockwinn Technology, Dallas, TX (US)

( * ) Notice: Subject to any disclaimer, the term of this patent is extended or adjusted under 35 U.S.C. 154(b) by 566 days.

(21) Appl. No.: 11/836,940

(22) Filed: Aug. 10, 2007

(65) Prior Publication Data

US 2009/0040048 A1 Feb. 12, 2009

(51) Int. Cl.
*G08B 1/08* (2006.01)
*G08B 13/14* (2006.01)
*G08B 13/00* (2006.01)

(52) U.S. Cl. ..... 340/572.1; 340/539.11; 340/539.13; 340/539.22; 340/572.7; 340/573.1; 340/573.4

(58) Field of Classification Search ..... 340/539.13, 340/539.22, 539.23, 571, 572.1, 573.1, 692, 340/539.11, 539.3, 573.41
See application file for complete search history.

(56) References Cited

U.S. PATENT DOCUMENTS 6,265,975 B1 * 7/2001 Zimmerman ..... 340/571
6,342,836 B2 * 1/2002 Zimmerman ..... 340/571
6,624,752 B2 9/2003 Klitsgaard et al.
6,662,078 B1 12/2003 Hardgrave et al.
6,802,659 B2 10/2004 Cremon et al.
6,842,121 B1 1/2005 Tuttle
6,970,088 B2 11/2005 Kovach
6,975,222 B2 * 12/2005 Krishan et al. ..... 340/539.13
7,009,512 B2 * 3/2006 Cordoba ..... 340/539.23
7,030,732 B2 4/2006 Tuttle
7,042,360 B2 * 5/2006 Light et al. ..... 340/572.1
7,088,229 B2 8/2006 Johnson
7,133,704 B2 11/2006 Twitchell, Jr.
7,155,264 B2 12/2006 Twitchell, Jr.
7,158,030 B2 1/2007 Chung
7,170,407 B2 1/2007 Wagner
7,209,468 B2 4/2007 Twitchell, Jr.
7,209,771 B2 4/2007 Twitchell, Jr.
7,265,665 B2 * 9/2007 Bouchard et al. ..... 340/539.11
7,825,794 B2 * 11/2010 Janetis et al. ..... 340/539.13
2004/0124982 A1 7/2004 Kovach
2004/0252030 A1 12/2004 Trimble et al.
2006/0148443 A1 7/2006 Burg et al.

(Continued)

OTHER PUBLICATIONS

Peter Svensson; Technology News, Bluetooth Links Up With Rival Technology; http://story.news.ask.com//article/20070612/D8PNCRI80.html, Jun. 12, 2007.

(Continued)

*Primary Examiner* — Benjamin C Lee
*Assistant Examiner* — Lam P Pham
(74) *Attorney, Agent, or Firm* — David W. Carstens; Steven H. Washam; Carstens & Cahoon LLP

(57) ABSTRACT

An improved system for tracking luggage and other such objects. The system features a transmitter tag for attachment to an object to be tracked and a receiver. When the tag comes within range of the receiver, the receiver provides notification to the user both visually and audibly. Audible notification can occur through the receiver's speaker, a wireless phone, a PDA, or an iPod or other portable music player. GPS capabilities allow the tag to store and transmit its exact coordinates to assist in locating the tag. Airport and airline security personnel can access the tag data with a dedicated interface device.

7 Claims, 3 Drawing Sheets

U.S. PATENT DOCUMENTS

| | | | | |
|---|---|---|---|---|
| 2006/0220829 | A1 | 10/2006 | Johnson | |
| 2006/0220857 | A1 | 10/2006 | August et al. | |
| 2006/0266563 | A1 | 11/2006 | Kaplan | |
| 2007/0004431 | A1 | 1/2007 | Twitchell, Jr. | |
| 2007/0013519 | A1 | 1/2007 | Chung et al. | |
| 2007/0103296 | A1 * | 5/2007 | Paessel et al. | 340/539.22 |

OTHER PUBLICATIONS

Gordon Padkin; Choice for Zigbee PAN Coordinator; EE Times Asia; http://www.eetasia.com/ART_8800378148_499488_095220ee.HTM; Oct. 3, 2005.

RFID Basics-FAQs; https://www.zebra.com/id/zebra/na/en/index/rfid/faqs/rfid_basics.html, 2007.

Scott E Rickert; Industry Week: Taking The NanoPulse—My RFID Tag is Small Than Your RFID Tag; http://www.industryweek.com/ReadArticle.aspx?ArticleID=13702, 1998.

Mark Roberti; RFID Journal-baggage Tagging Is A No-Brainer; http:www.rfidjournal.com/article/articleprint/2706/-1/1; Oct. 9, 2006.

Mark Shafer and Faique Sayeed, White Paper Series; RFID: Opportunities and Advantages in Baggage Handling; nestFrequency, LLC, 2004.

AVAANA—RFID Products, Solutions & Services—Antenna, Reader, Tags Products—Walmart, . . . ; http://www.avaana.com/applications.html, 2006.

WorldTrack—Tiny Real Time GPS Tracking; World's Smallest Global Positioning 16 Satellite Real Time Tracking System; http://www.brickhousesecurity.com/worldtrack-small-covert-gps-tracking.html, 2006.

CWT Traveler—Technology; Logan Airport to test new luggage tracking system; Boston Globe; http://www.carlsonwagonlit.com/en/countries/us/cwttraveler/2007_01/technology/, Jan. 2007.

Karen West; Vegas bets on radio chips for luggage problems; Oct. 13, 2006; http://www.msnbc.msn.com/id/15235999/.

Staff, ZDNet Asia; Jul. 17, 2003; Japan firms to test radio-tagged luggage; URL: http://www.zdnetasia.com/news/hardware/0,39042972,39141188,00.htm; http://zdnetasia.com/news/hardware/printfriendly.htm?AT=39141188-39000006c.

Bob Brewin; Delta Air plans RFID bag-tag test; Jun. 18, 2003; http://www.computerworld.com/mobiletopics/mobile/story/0,10801,82266,00,html.

Bluelon; http://www.bluelon.com/; WatchTag WT-004; http://www.bluelon.com/index.php?id=264, 2006.

Visible Assets Inc.—Real Time Asset Intelligence; http://www.visibleassets.com/content/t-tags.shtml, 2004.

ZigBee Alliance, Wireless Control That Simply Works,2007.

G2 Microsystems | Ultra-low Power Wi-Fi; G2 Microsystems, Inc.; 2007; http://www.g2microsystems.com/.

Jack Shandle; Wireless Net DesignLine/ G2 Micro gives RFID a Wi-Fi connection; Mar. 27, 2006; http:/www.wirelessnetdesignline.com/184400111;jsessionid=OFKD3B0GUHSPKQSNDLRCKHSCJUNN...

James Pilcher; Finding lost luggage—quickly; Thursday, Jul. 1, 2004; http://www.enquirer.com/editions/2004/07/01/biz-delta01.html.

Luggage Forward Launches Mobile Tracking System; http://www.luggageforward.com/press/pr_03222006.htm, Mar. 22, 2006.

globalsources; RFID tag manufacturers & suppliers; http://www.globalsources.com/gso1/I/RFID-tag-manufacturers/b/2000000003844/3000000183852..., 2007.

fuzing.com; luggage alarm, child guard, security anti-theft, anti-lost alarm; Winslim Electroninc Co. Ltd.; http://www.fuzing.com/vli/000789812340/luggage-alarm-child-guard—security-anti_theft-anti_los..., 2003.

Jonny Evans; At last, iPods with video get audio recording; TuneTalkStereo; Macworld Plus iPod User Guide 2006, p. 58.

Luggage Locator, INNOVATIONHOUSE.COM, copyright 1999.

* cited by examiner

INTELLIGENT LUGGAGE TAG

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to a system and method for locating and identifying an object. More specifically, the invention relates to a tag that can store and transmit data and can be placed on an object being conveyed, such as a piece of luggage.

2. Description of Related Art Including Information Disclosed Under 37 CFR 1.97 and 1.98

Luggage lost during air travel costs upwards of US $1 billion annually. In addition to the cost, lost time and inconvenience to the traveler compound this figure. To reduce these losses, numerous tracking devices have been developed.

The most basic form of luggage tracking in widespread use is the barcode labels that baggage check-in personnel attach to the luggage handle. While limited in the amount of data it can represent, barcodes can convey information such as the flight for which the bag was intended.

A Barcode as a means of tracking is entirely passive and requires significant physical contact with the item in order to ascertain its limited data. For example, in a stack of luggage with nothing but barcode labels, a baggage sorter must physically scan each tag with a barcode reader to determine which flight the luggage belongs on. Further, the barcode label may be obscured and may require the removal of numerous bags in order to gain access, or it may be unreadable due to damage or missing entirely. Wireless tracking devices have developed to counter this problem.

Most current tracking devices focus on the use of RIFD chips with tracking information stored onboard. Others use Bluetooth or other proprietary wireless communications protocols. Although they represent improvements over barcode use in luggage tracking, significant problems with these devices have slowed their adoption.

Airlines have experimented with replacing the barcode labels with RFID chips. However, this has proven costly even though individual chips are relatively inexpensive (at approximately $0.10 a piece) given the sheer number of pieces of luggage that must be transported daily. Moreover, equipment to program and read such devices can be costly as well.

RFID chips are also significantly limited in the amount of data they can store, the distance over which they can communicate, and the number of chips which can be in a given location and still transmit useful data. More detailed information is necessary for airlines to maintain security in the post-9/11 world. This includes details such as: personnel or stations where the bag was inspected; personnel who transported the bag; locations in which the bag was stored; and the flights on which the bag was transported. RFID chips, alone, cannot realistically support, transmit, or otherwise handle this volume of data.

From the traveler's standpoint, whether his or her luggage is being tracked with a barcode or with an RFID chip is irrelevant. Such devices are intended primarily for the benefit of airline personnel. These tracking devices do little to assist the traveler in locating his or her luggage upon arrival at the luggage claim area. Travelers must still congregate around the luggage carousel in hopes of visually spotting their luggage among the multitude of others.

Accordingly, a need exists for an inexpensive personal object tracking device that allows a traveler to easily locate his or her luggage amid a multitude of other pieces of luggage. Further, a need exists for a personal object tracking device that provides a useful notification to the user of the actual location of the tracked luggage. Further, a need exists for a personal object tracking device that stores and transmits more detailed information regarding the tracked luggage in order to assist airlines in maintaining security and properly routing luggage. Further, a need exists for a personal object tracking device that can be utilized to detect the proximity of disparate objects related to travel. The present invention satisfies these needs and others as described in further detail below.

BRIEF SUMMARY OF THE INVENTION

The present invention provides an object tracking and identification system. In one embodiment, the system includes a wireless transmitter tag and a receiver, each housed within a durable enclosure. The tag is attachable to an object to be tracked, such as a piece of luggage used during air travel. The receiver is compact and can be attached to a user's keychain or otherwise carried on the user's person. The tag and receiver are joined by a docking port and are configured using a PC via a USB or wireless connection.

The tag is designed to notify the receiver, via one or more RF transceivers (such as RFID, Bluetooth™, and ZigBee®) of the proximity of the tag. In one embodiment the tag will cause the receiver to sound an audible alarm or play a specific tone or audio file when the tag (and object) comes within approximately 30 to 50 feet of the receiver. If the tag then comes within approximately 3 to 5 feet of the receiver the audio notification changes yet again. This is to signal the user that the tag (and object) is near. Another embodiment provides notification if the object travels beyond the aforementioned distances.

In addition to the system's receiver, a traveler using the system may use a wireless phone, PDA, PC, or portable music player as an alternate notification device. The receiver may be docked with the music player and cause the player to play a specific audio file as an audible notification to the traveler. For example, if the receiver is docked with an iPod® the receiver can cause the iPod® to play a particular audio file when the tag is within a certain proximity to the receiver.

Other devices that possess Bluetooth™ or ZigBee® capability can be paired with the tag/receiver and receive the notification command wirelessly. Thus, the notification can be an audible tone (such as a ringtone) and/or a visual notification (such as lights or screen display). If the traveler is using a wireless phone, the receiver can produce an audible notification to the traveler over the phone. In conjunction, the receiver can trigger the phone to send a text notification to an awaiting driver to stop by the baggage claim area to pick up the traveler.

In another embodiment, the system further comprises a dedicated proprietary security interface device to allow airport security personnel to access the tag's data. The tag is designed to transmit preprogrammed information stored within the tag to this interface device. This information may include, but is not limited to: owner identity and address; flight information; handling information; content information; transport information; and position information. If security personnel inspect or otherwise handle the bag, the tag's information can be updated to assist in a more thorough security screening.

In another embodiment, the system also includes a GPS chip integrated within the tag. This allows the tag to track its own position and store its location within the onboard memory. When read, the tag can provide additional information such as the exact route it has followed. The device can also transmit its exact GPS coordinates when interrogated. For example, if the tag is able to access a sufficient number of GPS satellites, the coordinates it provides will be the bag's present location. The receiver device can also interrogate the tag and provide this location information to the user.

As a bag is handled, the baggage handlers access the tag to obtain its stored owner and flight information. With GPS capability, the tag also shares its travel path coordinates. As the tracked object is moved, such as from flight to flight, the tag periodically checks its GPS coordinates and logs any changes. An airline may then post this information on an internet accessible database for access by travelers. This tracking information may also assist Homeland Security in determining the approximate path taken by a particular piece of suspect luggage.

Other objects may be tracked by the present invention as well. For example, the tag may be clipped to the visor of an auto in the airport parking lot to assist the user in locating the auto. Another embodiment features a credit card sized tag that can be placed in a wallet or purse. If the wallet or purse is misplaced or stolen, the receiver will notify the user that the object is no longer within 3 to 5 feet of the receiver.

BRIEF DESCRIPTION OF THE SEVERAL VIEWS OF THE DRAWING(S)

The present invention will be more fully understood by reference to the following detailed description of the preferred embodiments of the present invention when read in conjunction with the accompanying drawings, in which like reference numbers refer to like parts throughout the views, wherein.

Figure 1:
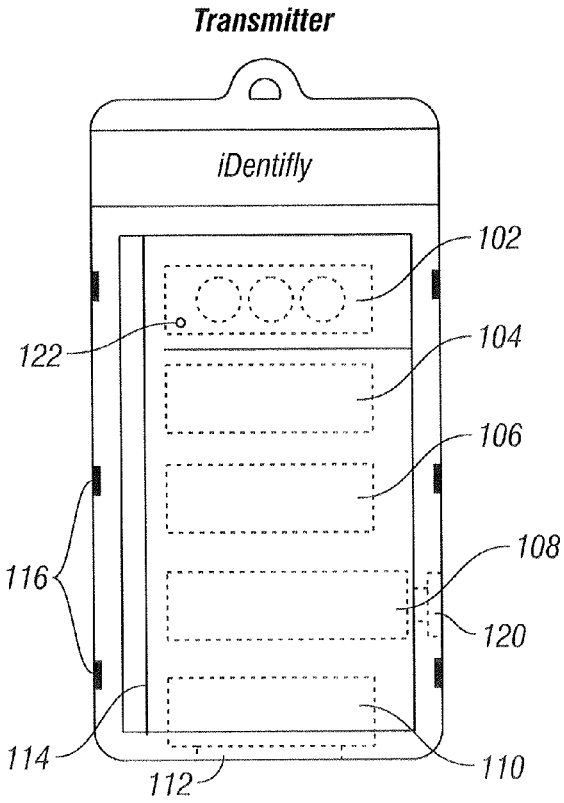
FIG. 1 is a block diagram of the transmitter tag, featuring basic elements as well as optional elements.

Where used in the various figures of the drawing, the same reference numbers designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood (58,266).

DETAILED DESCRIPTION OF THE INVENTION

Figure 2:
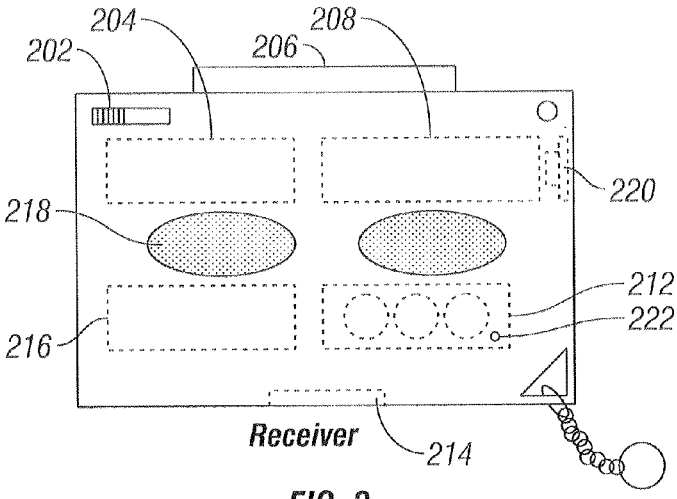
FIG. 2 is a block diagram of the receiver, featuring basic elements as well as optional elements.

The first embodiment of the present invention features an object tracking system comprising a transmitter tag and a receiver. FIG. 1 provides a block diagram of the transmitter, while FIG. 2 provides a block diagram of the receiver. Each of the two devices is housed within a durable material, such as metal or plastic. The housings are preferably sturdy enough to withstand the abuse of baggage handlers and users alike, yet inexpensive enough to make the device affordable by the average technology consumer.

FIG. 1 in this embodiment shows a transmitter tag for attachment to an object to be tracked. The tag in its most basic configuration comprises: a microprocessor with memory 110; an RFID chip 104; a docking port 112; and a power source 102 for operation. In various other configurations, the tag may also comprise an LED or LCD display 114; LED indicator lights 116; a GPS module 108, an antenna 120, and/or a Bluetooth™ or Zigbee® transceiver 106.

FIG. 2 in this embodiment shows a receiver device for use with the tag of FIG. 1. The receiver in the basic configuration comprises: a microprocessor with memory 216; an RFID transceiver 204; a docking port 206; a USB port 214; speakers 218 and/or LED indicator lights; a power source 212; an antenna 220, and an on/off switch 202. In other configurations, the receiver may also comprise a Bluetooth™ or ZigBee® transceiver 208.

Figure 3:
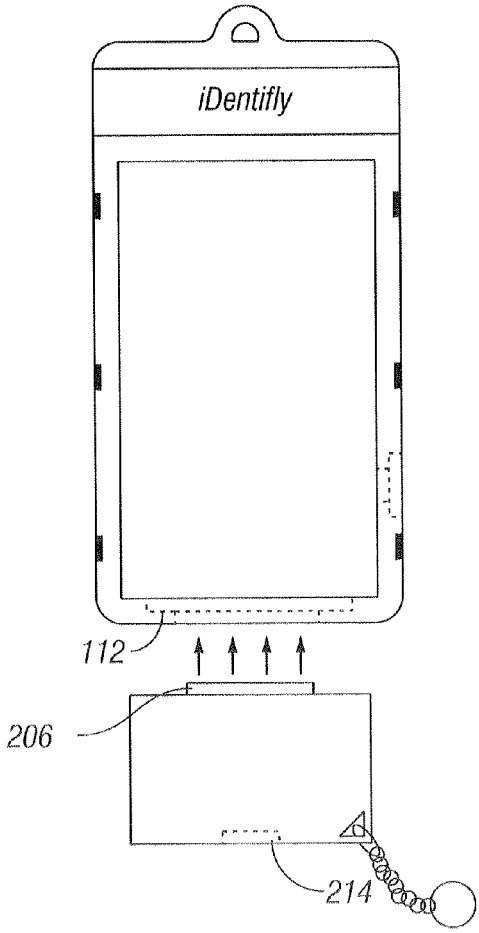
FIG. 3 is a block diagram showing the interconnection of the transmitter and receiver when performing initial configuration and programming.

FIG. 3 depicts how the tag and receiver interconnect. If the configuration includes a Bluetooth™ or ZigBee® transceiver, the tag and receiver must be paired. In this embodiment, both the tag and the receiver feature a sync button (122 and 222, respectively) within the respective battery compartments (FIG. 1, 102 and FIG. 2, 212). When the devices are paired, the tag is dedicated to the paired receiver. The receiver, however, may be paired with more than one tag.

In this embodiment, the tag and receiver are configured using a USB connection to a personal computer ("PC") running a proprietary software interface. As defined herein, a PC refers to any computing device capable of presenting the configuration interface to a user and accepting input from the user for performing device configuration. This USB connection also serves as a means for recharging each device's rechargeable batteries. To configure or charge the tag, it must be joined with the receiver and the receiver plugged into a powered USB port.

Before configuring the tag via the USB port 214, the receiver docking port 206 is joined with the tag docking port 112. A pass-through device in the receiver allows a connected PC to read data from and write data to the tag. If the tag features a Bluetooth™ or ZigBee® transceiver and/or GPS capabilities, it may also be configured and/or monitored with a wirelessly connected PC.

Using the USB port 214, the receiver can be programmed to play specific ringtones or other audio sounds when activated by the tag. If the receiver features a Bluetooth™ or ZigBee® transceiver, it may also be configured and/or monitored with a wirelessly connected PC.

Figure 4:
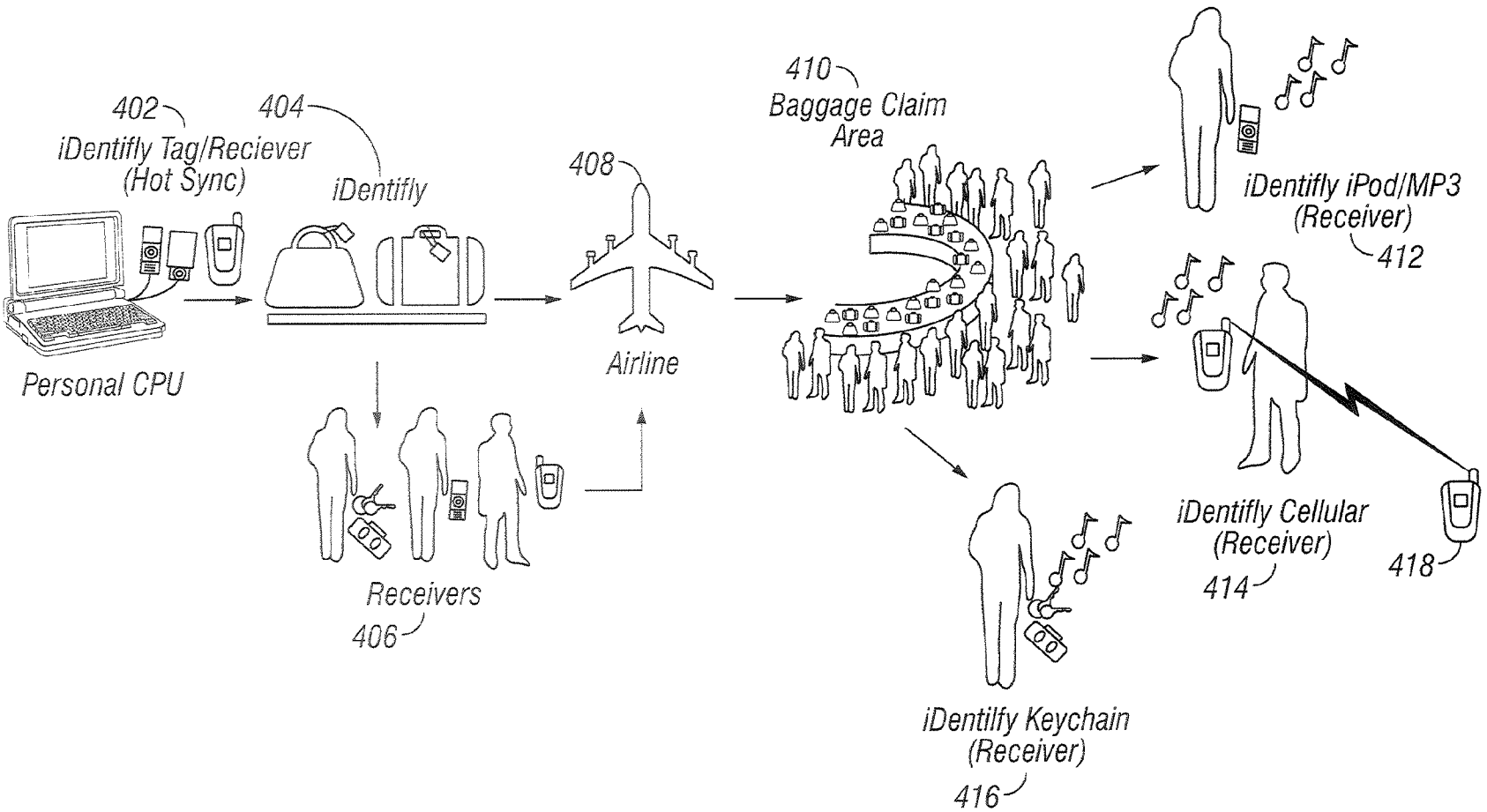
FIG. 4 is a depiction of a typical usage scenario wherein the tag is used by a traveler to track a piece of airline luggage.
Figure 5:
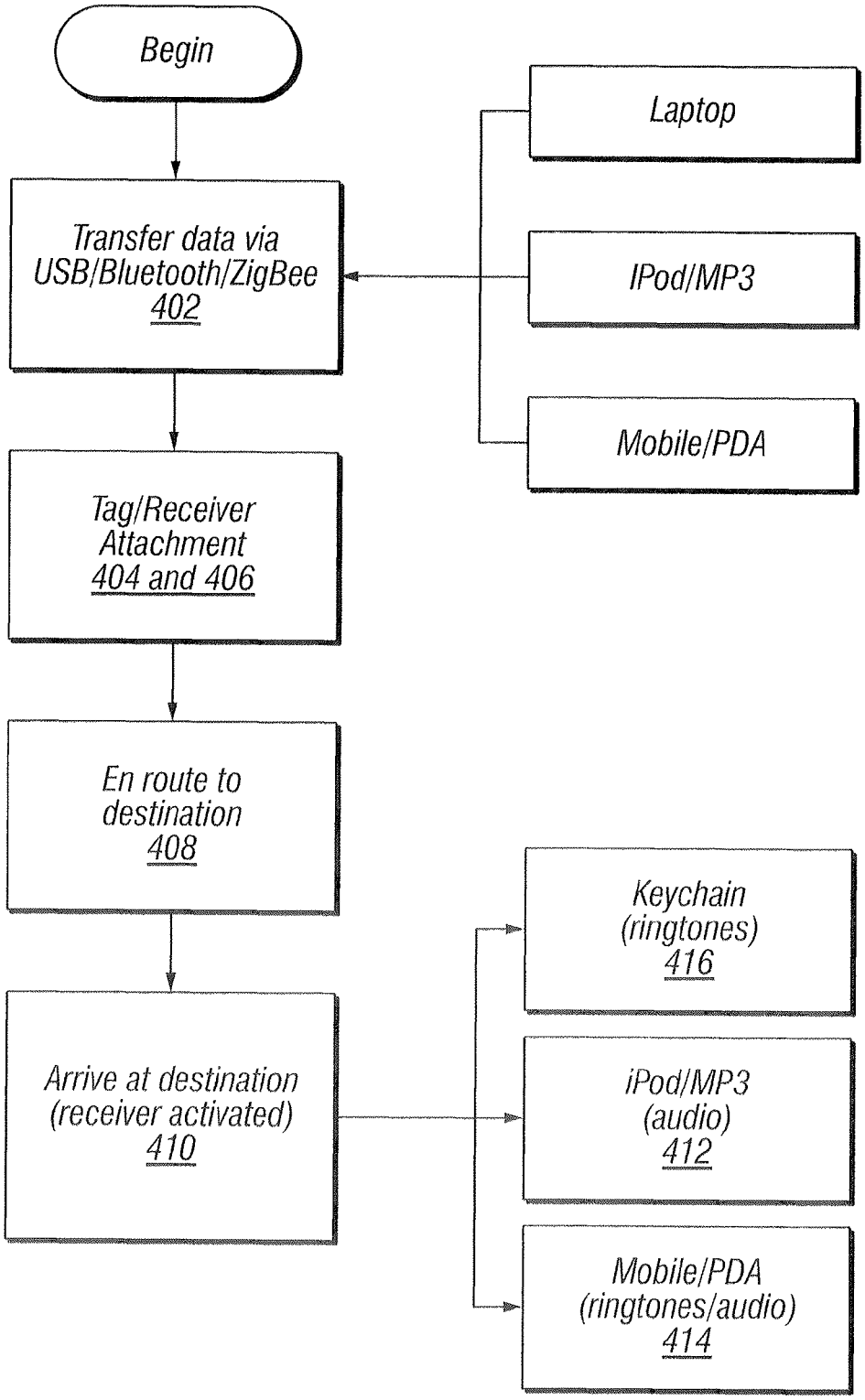
FIG. 5 is a flow diagram highlighting the usage steps represented by FIG. 4.

FIG. 4 depicts a typical usage scenario while FIG. 5 is a flow diagram of the usage steps embodied in FIG. 4. First the tag and receiver device must be initially configured. The tag and receiver are joined at the docking port and a PC is connected to the USB port 402. The computer is then used to reset and configure the device by storing owner, flight, and other identifying information.

In one embodiment, the data is mirrored between the tag and receiver. This allows the baggage claims personnel to access the receiver to automatically retrieve and verify the owner's information for a particular piece of lost luggage. This can also serve as a means of verifying the integrity of the passenger list with all checked pieces of luggage in the aircraft's cargo hold.

In another embodiment, tag data and receiver data differ. For example, owner, flight, and other identifying information are stored in the tag and not in the receiver. The receiver is configured to play a particular ringtone as an audible notification of the proximity of the tag.

Once the device is configured, the tag is attached to the luggage 404 and the receiver to the user's keychain 406. The luggage is loaded and the traveler then boards the flight 408. When the flight arrives at its destination, the traveler activates the receiver and proceeds to the luggage carousel to claim his or her luggage 410. While at the luggage carousel, the receiver will notify the traveler when the traveler's luggage is near (412-416).

In this embodiment, the receiver notifies the traveler by flashing its LED indicator lights and/or by sounding a ringtone or other audio file. The receiver may also be set to vibrate so as to be inobtrusive to others. If the tag has LED indicator lights, these lights flash as well.

The receiver detects the presence of the tag (and consequently, the object to which it is attached) via the onboard RF transceivers. Passive RFID technology provides a range of up to approximately 5 feet while Bluetooth™ provides a range of up to approximately 50 feet and ZigBee® a range of up to approximately 300 feet.

One embodiment uses passive RFID to detect the proximity of the tag to the receiver 416. When the tag comes within approximately 5 feet of the receiver, the receiver detects the unique RFID chip and receives its data. This causes the receiver to play the preconfigured ringtone and/or provide a visual indication to the traveler that his or her luggage is within this range of the receiver 416. By utilizing active RFID chips, this range can be extended to approximately 50 feet depending upon the conditions. Thus, when a tag comes within approximately 50 feet, a preconfigured audible or visual notification is provided. When the tag comes within approximately 5 feet of the receiver, a different preconfigured audible or visual notification is provided to indicate this change in proximity.

Another embodiment combines passive RFID with an active Bluetooth™ or ZigBee® transceiver. With this combination, the read range of the tag can be extended to approximately 50 feet (Bluetooth™) or to approximately 300 feet (ZigBee®). Thus, when the tag comes to within approximately 50 feet of the Bluetooth™ receiver, the receiver triggers its notification 416. The device then switches to passive RFID which shortens the detection range to approximately 5 feet. In this manner, the receiver can trigger a second, typically different, notification to inform the traveler that his or her luggage is within approximately 5 feet. This allows the traveler to stand back from the throngs waiting for bags at the luggage carousel and to only approach the carousel when the traveler's bag is near.

With ZigBee®, this range can be increased to approximately 300 feet. This can be helpful when attempting to interrogate a tag that is a distance away, such as in a parking lot or baggage storage. Another advantage of ZigBee® is the capability for self-configuring mesh networks. For example, a tag at one end of a large storage warehouse can communicate with other tags in the vicinity to effectively increase this detection range. Another example would be an airline passenger at the front of the passenger cabin interrogating the cargo hold for his or her luggage. If the tag on the passenger's luggage were at the remotest point of the cargo hold, it could communicate with the passenger's receiver by forming a mesh network with other tags in the hold.

In another embodiment the tag features an LED or LCD display. This allows the tag, when it comes within range of the receiver, such as on a luggage carousel, to provide additional visual information for owner identification. For example, the traveler's name could appear when the bag is within range. The tag can be programmed to display any type of visual data that the traveler desires.

In yet another embodiment of the tracking system, the tag comprises Bluetooth™ or ZigBee® technology to allow the device to be accessed wirelessly. Bluetooth™ and ZigBee® technology provide greater range and accessibility than mere RFID alone. With this capability, the tag and receiver can each be accessed and configured wirelessly by a Bluetooth™ or ZigBee® enabled PC, wireless phone, or PDA. Also, because Bluetooth™ and ZigBee® can penetrate objects more readily, the receiver has a greater chance of detecting a tag that is buried beneath other bags.

Another advantage of Bluetooth™ or ZigBee® capability is that the tag may now directly access a traveler's Bluetooth™ or ZigBee® enabled wireless phone, PDA, or other such device. Essentially any Bluetooth™ or ZigBee® enabled device can be paired with the tag and thus the paired device becomes the receiver. When the tag comes within range, the traveler is notified by a vibration, ringtone, or other audible sound made over the traveler's phone 414. If the traveler is on a call, the tag will trigger the phone with a "call waiting" type interrupt tone. If the traveler is using a Bluetooth™ or ZigBee® earpiece with his or her phone, the discreet audible notification will be heard over the earpiece.

If the traveler is using a phone as a notification device, the receiver can also cause the traveler's phone to send a text message to one or more additional phones. For example, the traveler can be waiting for luggage at a baggage carousel while another individual is in the airport parking lot waiting in a car to pick up the traveler. When the tag on the luggage approaches the traveler and triggers the receiver to provide the proximity notification, the traveler's phone also sends a preconfigured text message to the driver's phone 418 that the traveler is ready to be picked up. The actual text message that is sent can be established when configuring the overall device.

To safeguard the contents of the tag's memory, each access technology utilizes data encryption. This prevents others with Bluetooth™ or ZigBee® devices or with RFID readers from accessing the paired tag. Likewise, because the devices are specifically paired, only the traveler will receive the notification. This is so regardless of the number of tags operating in the vicinity.

If the traveler has multiple pieces of luggage, each with its own tag, the receiver and/or Bluetooth™ or ZigBee® enabled phone, PDA, or other such device can receive distinct notifications for each piece. For example, the PDA may display the bag description for the tag or tags currently before the traveler. As one of the tags comes within range of the PDA, the PDA can recognize the unique tag and display the preprogrammed bag description associated with the tag. As the other tags come with range, their respective data can be displayed as well. This data may either be recalled from the receiver or received during interrogation of the tag. This would assist the traveler in tracking each piece.

In another embodiment, the tracking system further comprises a dedicated proprietary security interface to allow airport and airline security personnel to access the tag's features. A security member is given an interface device that can access the RFID information to identify the traveler and the luggage's destination. The member may also alter the RFID data to provide a record of events such as a luggage inspection or detention. To further increase security and accountability, each access by a security member is logged in nonvolatile memory on the tag and cannot be altered except by the traveler.

If the tag and the interface device both have Bluetooth™ or ZigBee® capability, then the security member will have improved access to the tag's stored data. For example, the luggage may be checked at a security checkpoint and the security member may make a notation of the bag's contents by storing this information in the on-tag memory. This will allow future checks of the luggage to be compared to the contents as recorded at the first security checkpoint. If the contents differ, it can be readily established that the contents were tampered with.

Another benefit of Bluetooth™ or ZigBee® technology is that a greater number of tags can be interrogated than with RFID alone. For example, if a particular container in the cargo hold of the airliner needs to be inventoried; all a baggage handler need do is interrogate all of the tagged bags to scan their data. RFID provides some of this capability but is not as efficient at handling large numbers of RFID chips in the same locale.

Another embodiment of the tracking system uses the ZigBee® standard instead of Bluetooth™. The benefit of the ZigBee® standard is that it is significantly more energy efficient (longer battery life), has greater range, and allows for more efficient networking when interrogating multiple tags. Essentially, the tags can be designed to self-configure into a mesh network in order to allow all of the tagged bags in an entire airliner cargo hold to communicate with one another. This may allow a traveler in the passenger compartment to interrogate the tags in the cargo hold to verify that his or her luggage is onboard.

ipod® and MP3 portable music players are ubiquitous. Another embodiment of the travel system features a docking port that allows the receiver to dock with a portable music player. This allows the traveler to be listening to music while waiting for his or her luggage. When the luggage comes within range of the receiver, the traveler is notified through the music player with a preconfigured song or other audio cue 412. When the system is configured, the receiver is instructed as to the type of music player that is being used and which track to play.

In another embodiment of the present invention, the tag features GPS capabilities. With this, the tag can literally track the exact path taken by the luggage during its travels. At periodic intervals, the microprocessor in the tag can awaken and sample the current GPS coordinates. If they have changed, the new coordinates are logged. If a time reference is included, the time is logged as well. This allows security personnel to interrogate the tag to recreate the exact path taken during the luggage's travels.

While GPS typically requires line-of-sight transmission with the GPS satellites; the tag with no external antenna may still be able to obtain a GPS fix during its travels when exposed to the open sky. For example, loading and unloading an equipped piece of luggage during a flight will undoubtedly result in sufficient line-of-site exposure with the satellites. The tag may then obtain its GPS coordinates and log this value into memory. Addition of an external antenna to the tag will increase its sensitivity to the GPS satellite signals and allow the tag to obtain a position fix even without line-of-sight communication.

The present embodiment maintains a trail of the path taken by the tagged object. For example, when a tagged piece of luggage is checked it is transported to the airplane for loading. While it is outdoors, the tag obtains a location fix and logs this data with a time stamp. The tag then periodically awakens to obtain another location fix. The next time the tag is able to obtain a location fix, it logs this as well. In doing so, the path of the bag can be recreated. Also, when baggage handlers load or unload an airplane, they can use the handheld interface device to interrogate the luggage. This will read the location data from the tag in addition to other tag information. This data can then be made available on an online database to allow for improved lost luggage retrieval.

If the luggage is lost, the tag will always know its exact location and can relay them to the traveler to assist in locating the luggage. For example, if a baggage handler misplaces a piece of luggage, the baggage area can be interrogated using a handheld interface device. The luggage tag will respond with its coordinates and lead the handler to its location. If the tags feature ZigBee® capabilities, the tags can form a mesh network and locate one another over a considerable distance. The handheld interface device can then provide an approximation of the location of the tag by displaying the tag location relative to the interface device: by superimposing the location on a map; by flashing an LED relative to the distance relative to the tag; by providing an audio tone whose frequency or pulse is relative to the distance to the tag; or the like.

In a previously mentioned embodiment all tag and receiver data is mirrored, with all previously stored traveler information (i.e., personal contact information, flight details, luggage inventory and/or photo, etc.) contained in both tag and receiver memory. If the luggage does not arrive on the designated flight, the traveler could then stop at airline baggage service area to inform airline personnel that his or her luggage is lost by presenting his or her receiver. The airline baggage personnel could then access the data in receiver memory to obtain the complete traveler and luggage information. This information could then be checked against the baggage database to determine the exact location of the lost luggage and also verify that the traveler is the rightful owner. To assist in this verification, certain unique encryption keys could be present on both the tag and the receiver. Thus, neither the airline personnel nor the traveler would have to fill out forms, virtually eliminating mistakes inherent in guessing in terms of luggage size, type, color, content, etc. This would reduce the traveler's time waiting in the baggage claim line and improve overall airline customer service, efficiency, and security.

Airlines usually contract with a third party delivery service to deliver late, lost or misplaced baggage to the traveler's hotel room or other designated location. Typically, the airline will provide the traveler with a time "window" within which the luggage will be delivered. For example, the traveler may be told that the luggage will be delivered between 9 AM and 6 PM that day or the next. This can be quite frustrating when travelers typically face a busy schedule and are unable to remain in one location for the specified duration. With GPS capabilities in the tag, the traveler can log into the airline or third party tracking database to view the instant location of the luggage. From this data, the traveler may then ascertain whether the luggage is en route and when it will arrive.

Notifications may also be sent to the traveler's PC, PDA or wireless phone informing him or her of the luggage's delivery status.

One skilled in the art will appreciate that the disclosed tracking system can be used for tracking more than merely luggage. For example, a tag with the Bluetooth™ or ZigBee® transceiver can be attached to the visor of a traveler's automobile as well as to each piece of the traveler's luggage. The same receiver that detects the proximity of the luggage can then detect the proximity of the auto. When the traveler exits the airport and heads for the parking lot, his or her auto can easily be located by the flashing visual notification provided by the tag as well as the audible notification provided by the receiver or alternate notification device. The ZigBee® technology will allow detection of the auto at a distance of approximately 300 feet in all directions, depending upon the conditions. If the device also features GPS, the exact GPS coordinates can also be transmitted to the receiving device to provide greater detail as to the auto's location.

Personal items such as a wallet or purse can be tracked with the system as well. A basic tag with an RFID chip can be manufactured within a credit card form, or can be made part of a smart card as is currently offered by various credit card companies. This tag can be paired with the same receiver as mentioned previously. With such a tag in place, the receiver can be configured to provide notification if the tag exceeds the established monitoring proximity. For example, a user can place the tag card in his or her wallet. If the wallet is stolen or otherwise misplaced, the receiver will notify the user when the receiver is greater than approximately 5 feet from the tag.

It will now be evident to those skilled in the art that there has been described herein an improved object tracking system. This system provides value to a traveler in assisting him or her in tracking, for example, one or more pieces of luggage. By creating value for the traveler, more travelers will be willing to purchase the tags. This will assist the airlines by not requiring them to make the purchase themselves.

Although the invention hereof has been described by way of a preferred embodiment, it will be evident that other adaptations and modifications can be employed without departing from the spirit and scope thereof. For example, the tag/receiver system may be utilized to track a parent's children at an amusement park. If the children stray beyond the preconfigured proximity of the system, a notification will sound to allow the parent before the child has the opportunity to stray beyond visual range.

The terms and expressions employed herein have been used as terms of description and not of limitation; and thus, there is no intent of excluding equivalents, but on the contrary it is intended to cover any and all equivalents that may be employed without departing from the spirit and scope of the invention.

We claim:

1. A system for tracking the location of an object, the system comprising:

an object tag comprising:

an RFID device capable of storing object identification data; and a first RF transceiver device capable of accessing the stored object identification data and capable of establishing a network for the exchange of digital data with other object tags having same capabilities, wherein the networked object tags exchange at least a portion of the object identification data; and an operator tracking device comprising, a visible or audible notification device; and a second RF transceiver capable of wirelessly interfacing with the object tag RFID device and the first RF transceiver device, wherein the interfaced device is sensitive to the proximity of the tracking device, causing a corresponding visible or audible notification of the object tag's proximity to the tracking device;

wherein the RFID device is passive and the first RF transceiver device is active, wherein the operator tracking device detects the active RF transceiver device at a first distance from the object tag, and the operator tracking device detects the passive RFID device at a second distance from the object tag, the second distance being within the first distance;

wherein the network established between said object tags allows an operator using said operator tracking device to wirelessly interrogate an object tag attached to an object container to remotely examine the container's contents.

2. The system of claim 1 further comprising:

an interrogating receiver device having a third RF transceiver capable of wirelessly interfacing with the object tag RFID device or the first RF transceiver device, the interrogating receiver for use by a third party to obtain from the object tag at least a portion of the object identification data.

3. The system of claim 1, the object tag further comprising:

a GPS device for determining the GPS coordinates of the object tag, wherein the object identification data includes the GPS coordinates.

4. The system of claim 3 wherein the object tag maintains its most recently obtained GPS coordinates and wherein these GPS coordinates are transmitted to the tracking receiver.

5. The system of claim 3 wherein the object tag maintains its most recently obtained GPS coordinates and wherein these GPS coordinates are transmitted between similar object tags via an established network between the object tag and similar object tags, wherein the tracking receiver can locate an object tag by querying networked object tags.

6. The system of claim 3 further comprising:

an interrogating receiver having a third RF transceiver capable of wirelessly interfacing with the object tag RFID device or the first RF transceiver device, the interrogating receiver for use by a third party to obtain from the object tag at least a portion of the object identification data, wherein the object identification data includes a sequence of GPS coordinates for the object tag representing the physical travel path taken.

7. A method for tracking an object, the method comprising:

using a tracking device having an RF transceiver to wirelessly detect an object tag, the object tag having a passive RFID device capable of storing object identification data and an active first RF transceiver device, the tracking device first detecting the active first RF transceiver device at a first distance from the object tag and then detecting the passive RFID device at a second distance from the object tag, the second distance being shorter than the first distance; and providing a visible or audible notification to a user relative to the distance between the tracking device and the object tag;

establishing a network for the exchange of digital data between the first transceiver device and other object tags having same capabilities of said object tag, wherein the networked object tags exchange at least a portion of the object identification data and wherein this data is shared with the tracking device for remotely obtaining an object inventory.

* * * * *